US009246226B2

(12) United States Patent
Voss et al.

(10) Patent No.: US 9,246,226 B2
(45) Date of Patent: Jan. 26, 2016

(54) ANTENNA HORN WITH UNIBODY CONSTRUCTION

(71) Applicant: ViaSat, Inc., Carlsbad, CA (US)

(72) Inventors: John Daniel Voss, Cumming, GA (US); Terence D. Newbury, Hoschton, GA (US); James William Maxwell, Alpharetta, GA (US)

(73) Assignee: VIASAT, INC., Carlsbad, CA (US)

( * ) Notice: Subject to any disclaimer, the term of this patent is extended or adjusted under 35 U.S.C. 154(b) by 140 days.

(21) Appl. No.: 14/198,868

(22) Filed: Mar. 6, 2014

(65) Prior Publication Data

US 2014/0266942 A1 Sep. 18, 2014

Related U.S. Application Data

(60) Provisional application No. 61/791,232, filed on Mar. 15, 2013.

(51) Int. Cl.

| | |
|---|---|
| ***H01Q 13/02*** | (2006.01) |
| ***H01Q 15/22*** | (2006.01) |
| ***H01P 1/17*** | (2006.01) |
| ***H01Q 15/24*** | (2006.01) |

(52) U.S. Cl.

CPC ..... *H01Q 13/02* (2013.01); *H01P 1/17* (2013.01); *H01Q 13/0266* (2013.01); *H01Q 13/0283* (2013.01); *H01Q 15/242* (2013.01); *H01Q 15/244* (2013.01); *Y10T 29/49016* (2015.01)

(58) Field of Classification Search

USPC ..... 343/757

See application file for complete search history.

(56) References Cited

U.S. PATENT DOCUMENTS

| | | | | |
|---|---|---|---|---|
| 5,041,840 | A * | 8/1991 | Cipolla | H01P 1/173 343/700 MS |
| 6,642,900 | B2 * | 11/2003 | Bhattacharyya | H01Q 5/30 343/786 |
| 6,720,932 | B1 | 4/2004 | Flynn et al. | |
| 8,354,969 | B2 * | 1/2013 | Lin | H01Q 13/0241 333/21 A |
| 2008/0117005 | A1 | 5/2008 | Eom et al. | |
| 2008/0186113 | A1 | 8/2008 | Hoover | |
| 2013/0234904 | A1 * | 9/2013 | Blech | H01Q 13/06 343/776 |

FOREIGN PATENT DOCUMENTS

| | | |
|---|---|---|
| EP | 0380212 A2 | 8/1990 |

OTHER PUBLICATIONS

Extended European Search Report mailed in European Patent Application No. 14159856.5 on Jul. 7, 2014, 8 pgs.

* cited by examiner

*Primary Examiner* — Howard Williams

(74) *Attorney, Agent, or Firm* — Jonathan A. Kidney; TechLaw LLP

(57) ABSTRACT

A low cost antenna horn for outdoor use having an extended housing with a unibody construction to enclose a waveguide and polarizing septum, the assembly of which rigidly retains and orients the waveguide and polarizing septum without using traditional hardware or sealants.

20 Claims, 18 Drawing Sheets

1601

ANTENNA HORN WITH UNIBODY CONSTRUCTION

CROSS-REFERENCE TO RELATED APPLICATIONS

This application claims priority to currently pending U.S. patent application No. 61/791,232 filed Mar. 15, 2013 entitled Antenna Horn with Unibody Construction, the contents of which are incorporated herein by reference in its entirety.

FIELD OF THE INVENTION

The present invention relates to antennas, and more particularly to horn antennas with a circularly polarized feed having a singular external housing.

BACKGROUND

Communication systems that use circularly polarized signals require antennas with circular reflector profiles that decouple the two vector components that are separated by 90 degrees. Circularly polarized antennas maintain signal integrity by maintaining substantially the same signal magnitude at substantially the same orthogonal relationship. Circularly polarized antennas are useful for two-way satellite communications in which signals are transmitted in circular polarity.

Feed horns, those known in the art, are generally multipiece construction in order to manufacture the individual components such as the horn, the polarizer housing, the waveguide, and the polarizer. Many drawbacks exist in multipiece feed horns, particularly those for use in outdoor applications, including expensive gaskets and complicated assembly. Normally, the polarizer housing contains the waveguide and polarizer, which is then coupled to the horn and transceiver. These components are assembled with great care to ensure high performance with no moisture ingress. Even small gaps between components can contribute to large efficiency loss in signals, and provide an entry point for moisture that can then damage transceiver electronics. Complex, custom tooling and fixtures are used in order ensure alignment of the components and to facilitate manufacture. Thus, there is a need for a low cost, high volume, high performance, and highly reliable feed horn for outdoor applications.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In one aspect of various embodiments, an apparatus for satellite communication is provided, the apparatus comprising: a feed horn having a mouth aperture at a first end, a waveguide interconnect at a second end, and an integrated polarizer assembly housing between the first end and second end, the integrated polarizer assembly housing having an interior surface disposed about a central axis defining a longitudinal interior region; and a polarizer assembly in contact with at least a portion of the interior surface and contained substantially within the longitudinal interior region, the polarizer assembly comprising a waveguide channel and a polarizing septum positioned within the waveguide channel.

In another aspect of various embodiments, an apparatus for satellite communication is provided, the apparatus comprising: a unibody feed horn means having a polarizer assembly housing with a central longitudinal axis; means for guiding a signal; means for polarizing the signal; means for nesting the signal polarizing means within the signal guiding means, wherein the nesting means comprises a polarizer assembly; engaging means for engaging the polarizer assembly into the unibody feed horn means; and orienting means for orienting the polarizer assembly within the unibody feed horn means.

In still another aspect of various embodiments, a method for manufacturing a satellite communication apparatus is provided, the method comprising: a method of manufacturing an apparatus, the method comprising: forming a polarizer assembly having a waveguide and a polarizing septum; obtaining a feed horn having an extended housing disposed about a central longitudinal axis, wherein the extended housing of the feed horn includes an interior cavity; and inserting the polarizer assembly into the extended housing of the feed horn.

DETAILED DESCRIPTION

In the following detailed descriptions of various embodiments, reference is made to the accompanying drawings that form a part hereof, and in which is shown, by way of illustration, specific embodiments that may be practiced. It is to be understood that other embodiments may be utilized and structural changes may be made without departing from the scope of the present disclosure.

Figure 1:
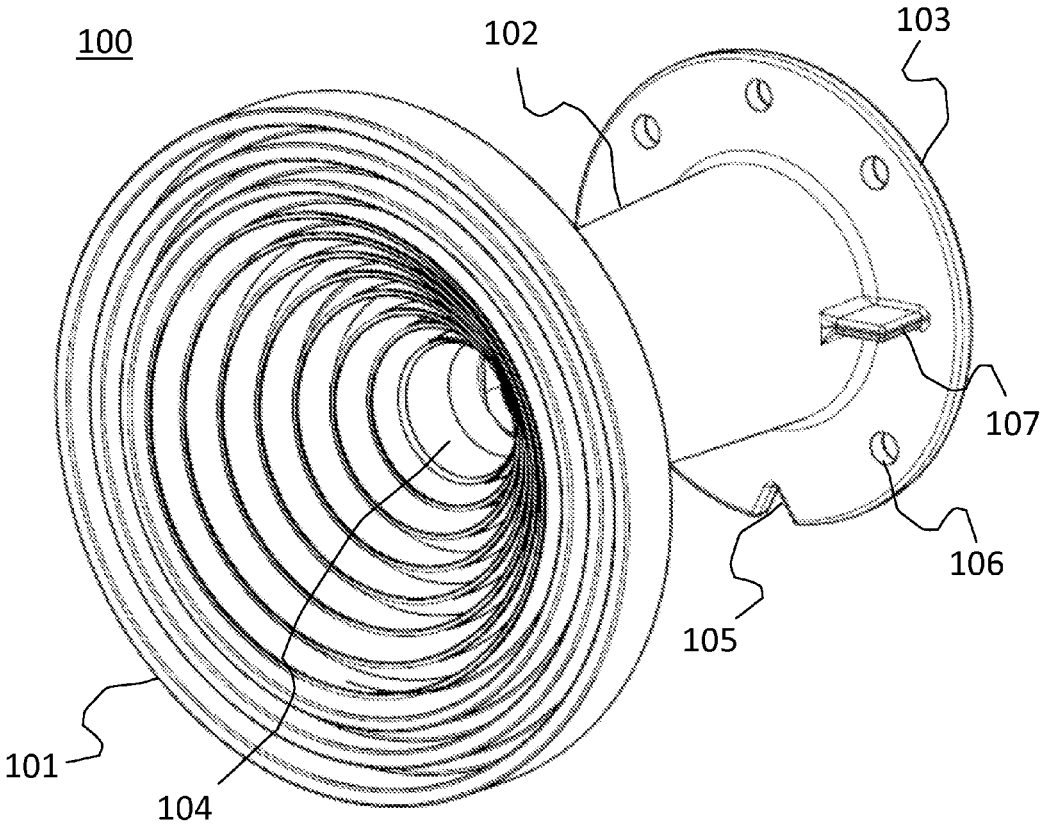
FIG. 1 is a perspective view of an embodiment antenna horn with unibody construction.

FIG. 1 is a perspective view of an embodiment antenna horn 100 with a unibody construction. The unibody may be constructed through one of several suitable processes such as machining, casting, forging, sintering, layered printing, or the like. External and internal geometries may be optimized through various constructions to minimize overall weight and cost, maximize strength and rigidity, both, or neither. The horn 101, otherwise known as a first end, may comprise a mouth aperture 104. A waveguide interconnect 103, otherwise known as a second end 201, may comprise a flange with bolt pattern 106, an assembly orientation notch 105, and a polarization orientation tab 107. The horn 101 has an integrated polarizer assembly housing 102 that may uninterruptedly link the horn 101 to the waveguide interconnect 103, and the internal components (see FIG. 2) may be housed within the integrated polarizer assembly housing 102.

In an embodiment, the integrated polarizer assembly housing 102, alternatively referred to as a horn with extended housing 602,902,1202 disposed about a central longitudinal axis 401, may be a single component formed by any of the several processes previously mentioned. The singular body, or unibody, eliminates joints and the need for gaskets, eliminates the need for bolts or other connecting means to join the horn 101, waveguide housing (not shown), and waveguide interconnect 103, and simplifies manufacture by eliminating complex alignment fixtures.

Figure 2:
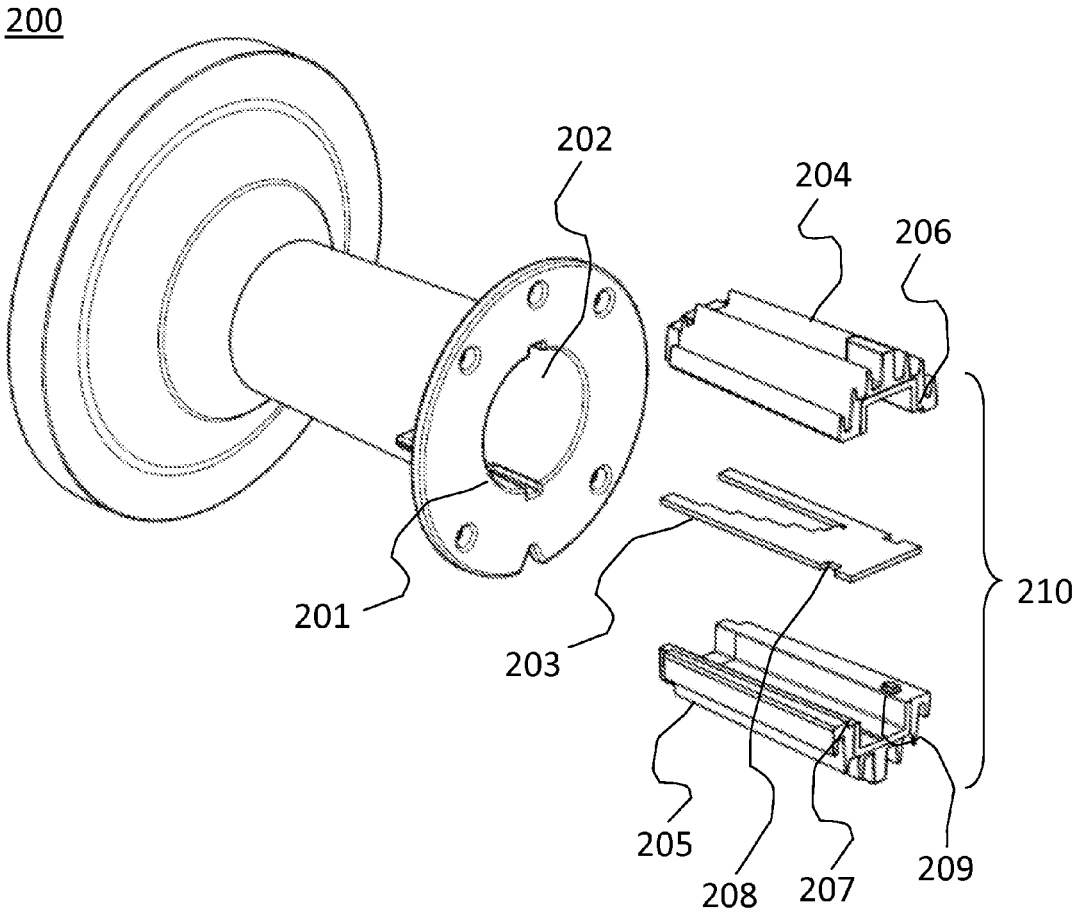
FIG. 2 is a rear, exploded perspective view of FIG. 1.

The internal components can be seen more clearly in FIG. 2, an exploded perspective view of FIG. 1, as a first waveguide half 204 and a second waveguide half 205. In an embodiment, the waveguide halves 204,205 may be substantially identical in order to minimize part variation, increase amount of product produced per unit time, and reduce cost. The waveguide halves 204,205 may have a plurality of mating surfaces 305, 306 adjacent to the polarizing septum alignment ridges 206, 207 that may engage during assembly and/or after insertion into the integrated polarizer assembly housing 102. A first waveguide half 204 comprises a first mating surface 305 and the second waveguide half 205 comprises a second mating surface 306. The waveguide halves 204,205 may comprise polarizing septum alignment ridges 206,207 formed to a depth that is at least less than the thickness of a polarizing septum 203. The waveguide halves 204,205 may sandwich the polarizing septum 203 therebetween prior to insertion into the integrated polarizer assembly housing 102.

In an embodiment, the waveguide halves 204,205 may be formed as a single component with polarizing septum alignment ridges 206,207 longitudinally formed into the interior surface 403. The polarizing septum 203 may be press-fit into a singular waveguide (not shown) with an axial force from the end comprising the waveguide interconnect 103. In this manner, the polarizing septum is nested within the singular waveguide. Additional nesting means are contemplated such as welding, molding the waveguide (not shown) around the polarizing septum 203, casting the polarizer assembly 210 as a whole, machining, or the like.

The polarizing septum 203, including additional means for polarizing a signal, converts between both sense of circular polarization and linear depending on the direction of the propagating signal; i.e. transmit or receive. In an embodiment, the polarizing septum 203 may be stepped, tapered, or other suitable configurations.

In an embodiment, the waveguide halves 204,205 may also comprise at least one protruding boss 209 adapted to engage a corresponding notch 208 in the polarizing septum 203 in order to longitudinally position the polarizing septum 203 within the polarizer assembly 210. The integrated polarizer assembly housing 102 has an interior surface 202, which may also be defined as the longitudinal interior region. The interior surface 202 may be conical and may at least partially engage the exterior surface of the waveguide halves 204,205, which may be tapered at substantially the same angle as the conical interior surface 202. In an embodiment, the outer surface is interspersed with longitudinal fins 304 of the waveguide half 204 and may engage the interior surface 202 after at least partial insertion into the integrated polarizer assembly housing 102.

Figure 3:
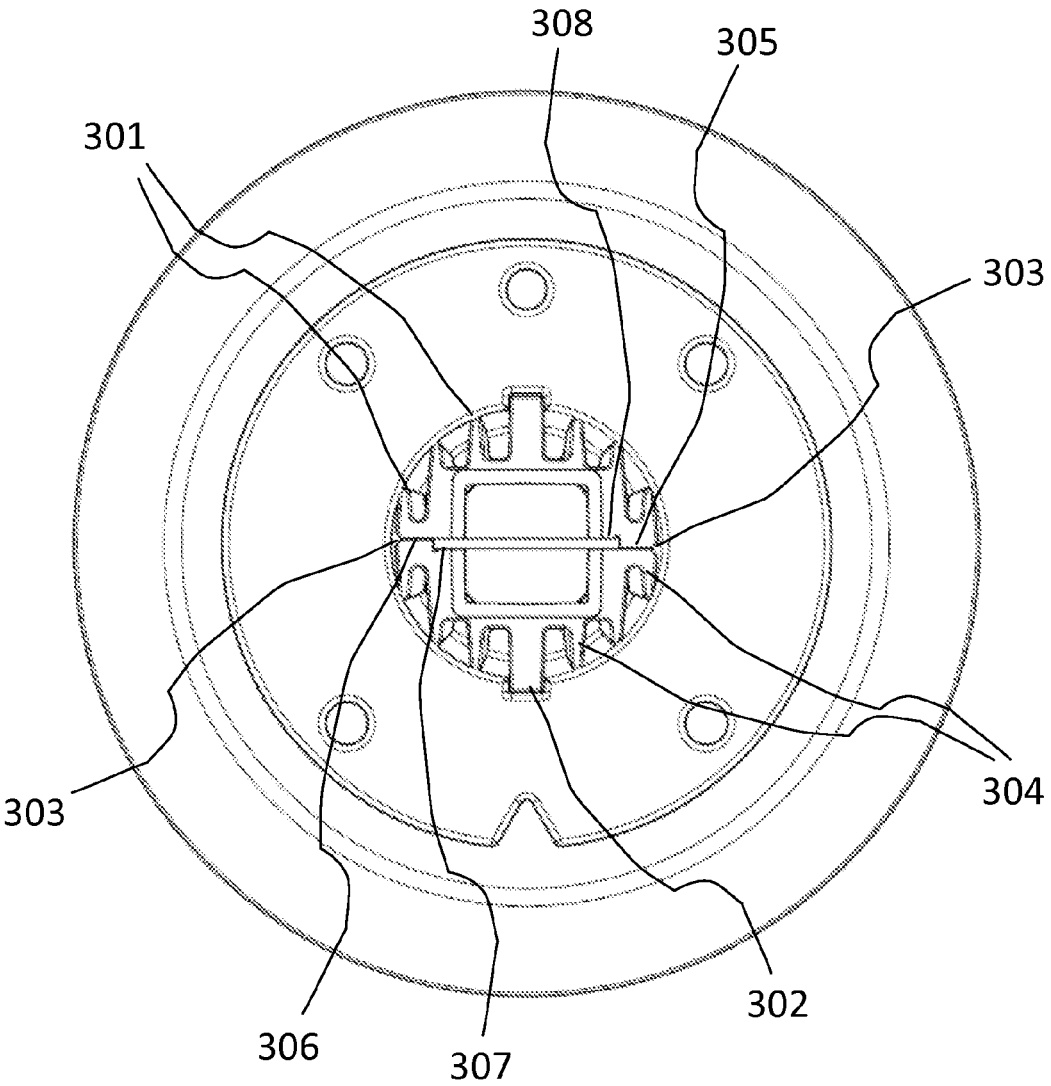
FIG. 3 is a rear end view of an embodiment antenna horn.

A rear end view of an embodiment of an antenna horn 100 is illustrated in FIG. 3. Fins 304 of the waveguide halves 204,205 engage the antenna horn 100 at various interface points 301 along the circumference of the interior surface 202. In an embodiment, the waveguide halves 204,205 and polarizing septum 203 may loosely join to form the polarizer assembly 210 and the polarizer assembly 210 may slide into the integrated polarizer assembly housing 102 from the second end 201 to press-fit against the interior surface 202. A force applied by the press-fit engagement may act in a direction substantially perpendicular to and radially inward from the interior surface 202, and is transferred through the fins 304 toward the polarizing septum 203. In this manner, the force substantially rigidly clamps the polarizing septum 203 between the waveguide halves 204,205 to maximize signal transmission efficiency. Optimum signal transmission performance may be achieved when the force causes the polarizing septum 203 to be substantially uniformly loaded along the polarizing septum alignment ridges 307,308, shown in FIG. 3 from the second end 201. These ridges 307,308 run substantially parallel to the longitudinal axis 401, in a direction of the propagating signal, e.g., the first end 101 toward the second end 201.

Whereas in the aforementioned embodiment with substantially uniform loading along the polarizing septum 203, conversely, force may not be applied at locations 303 because none of the various interface points 301 intersect the interior surface 202 at locations 303. It is contemplated that a different arrangement of fins 304 and/or a different number of fins 304 may accomplish substantially the same radial load. For example, the fins 304 may radiate outward from the central longitudinal axis 401 rather than only perpendicular to the mating surfaces 305,306.

The orientation of the polarizing septum 203 relative to the waveguide interconnect 103 affects the performance of the antenna 100,200. In an embodiment, at least one keying feature 302 provides a means to orient the polarizer assembly 210 upon insertion into the integrated polarizer assembly housing 102. A key 302 may be adapted for insertion into the waveguide interconnect 103. The keying feature 302 may be a traditional key and keyway, a custom key and key slot, round pin and bore, spline, or other suitable forms.

Figure 4:
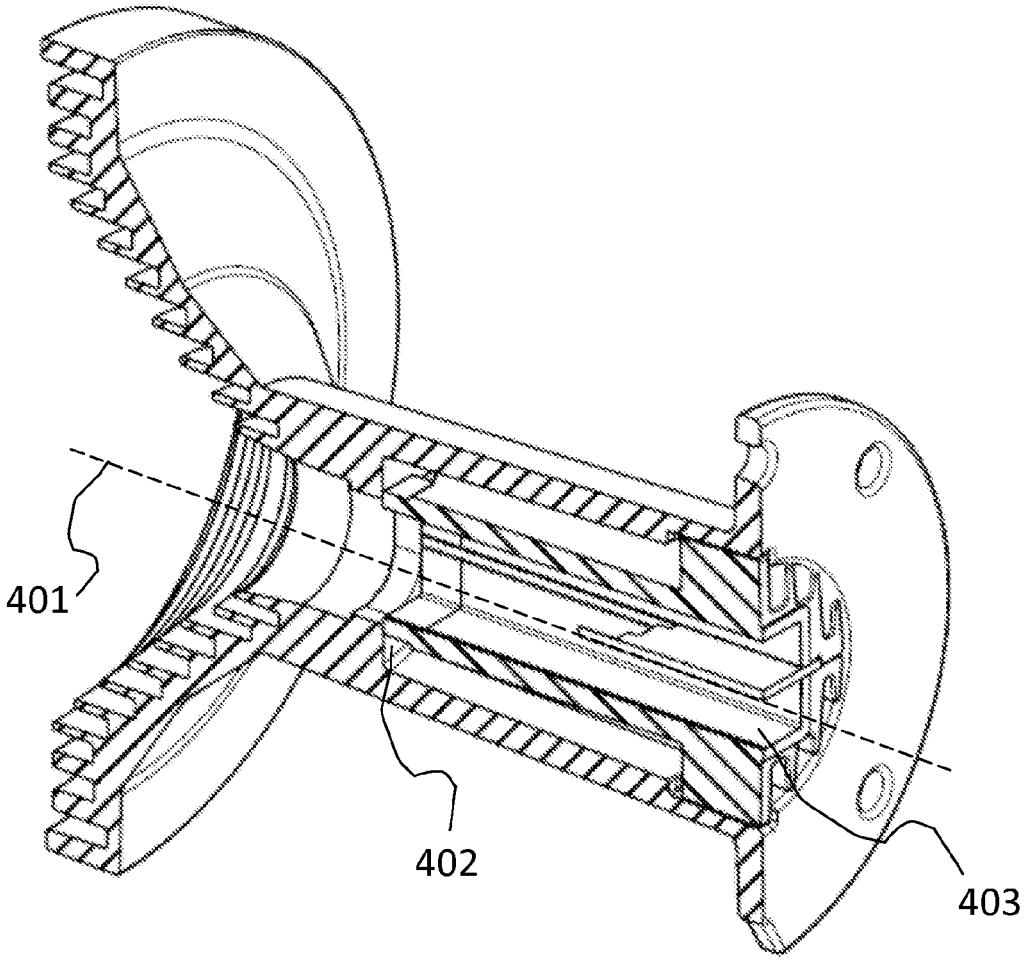
FIG. 4 is a perspective section view of FIG. 1.
Figure 5:
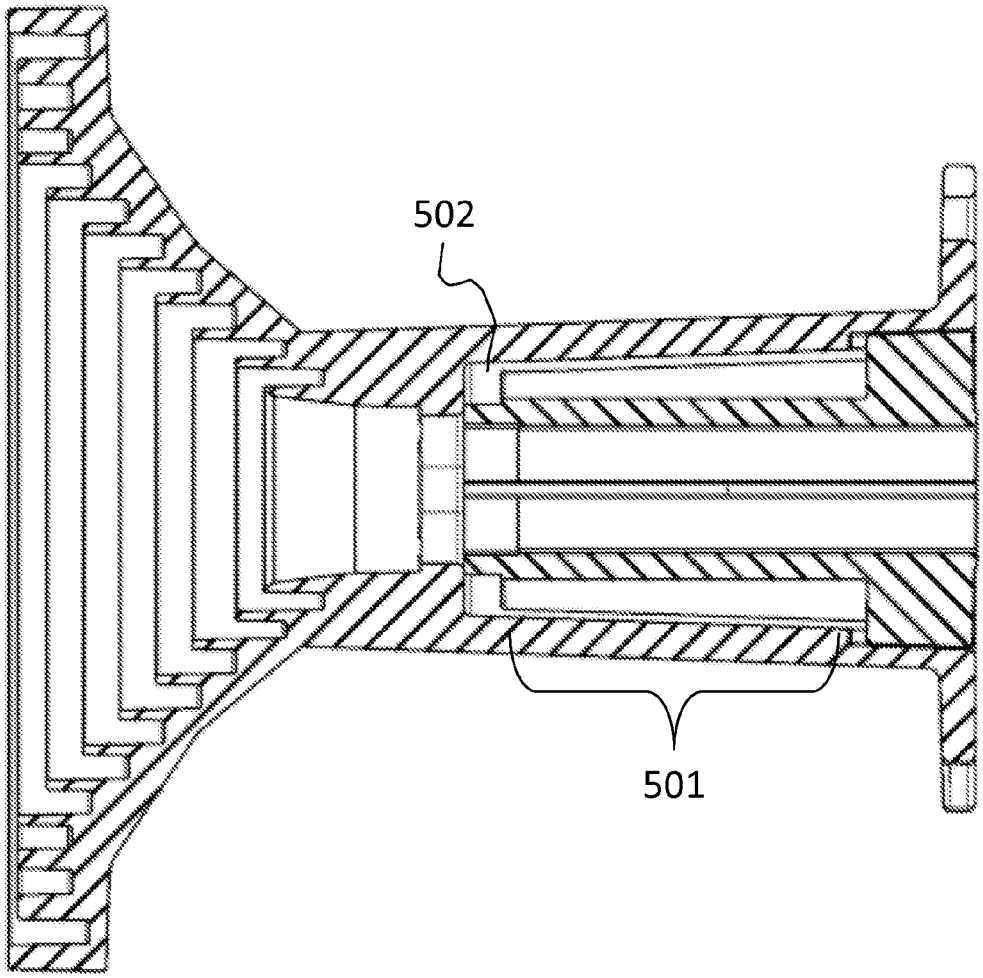
FIG. 5 is a side section view of FIG. 1.

Turning now to FIG. 4 and FIG. 5, an illustration is provided to shown a perspective section view of FIG. 1 and a side section view of FIG. 1. In FIG. 4, a central longitudinal axis 401 is shown with the antenna horn 100 disposed about the axis 401. The waveguide channel 403, of the waveguide 204, 205 is substantially orthogonally disposed about the axis. The internal waveguide channel 403 guides the signal to and from the transceiver (not shown). Means for guiding the signal may be altered to change signal transmission performance. Examples of altered signal guiding means may include interior corners of the waveguide channel 403 having radii, a tapered interior surface 201, and a textured interior surface 201.

In an embodiment, a ledge 402 formed in the integrated polarizer assembly housing 102 may provide a limit for insertion depth of the polarizer assembly 210. As illustrated in FIG. 5, the interior surface 202 of the integrated polarizer assembly housing 102 may be tapered to engage the polarizer assembly 210 at a longitudinal location 501. This longitudinal location 501 may vary to adjust the amount of radial clamping force or may vary due to manufacturing tolerances. Once engaged, continuing to apply force to the polarizer assembly 210 in a direction substantially parallel to the central longitudinal axis 401 may begin deforming material in at least one of the waveguide halves 204,205, the integrated polarizer assembly housing 102, or both. An interior region 502 defined by a tube in the shape of a cylinder, toroid, rectangle, square or other hollowly shaped tube, may provide a reservoir for material buildup that may be ablated from the integrated polarizer assembly housing 102, waveguide halves 204,205, or both, by the insertion of the polarizer assembly 210. In this manner, the reservoir may allow the polarizer assembly to fully seat upon the ledge 402 because ablated material does not interfere with insertion depth.

Figure 6:
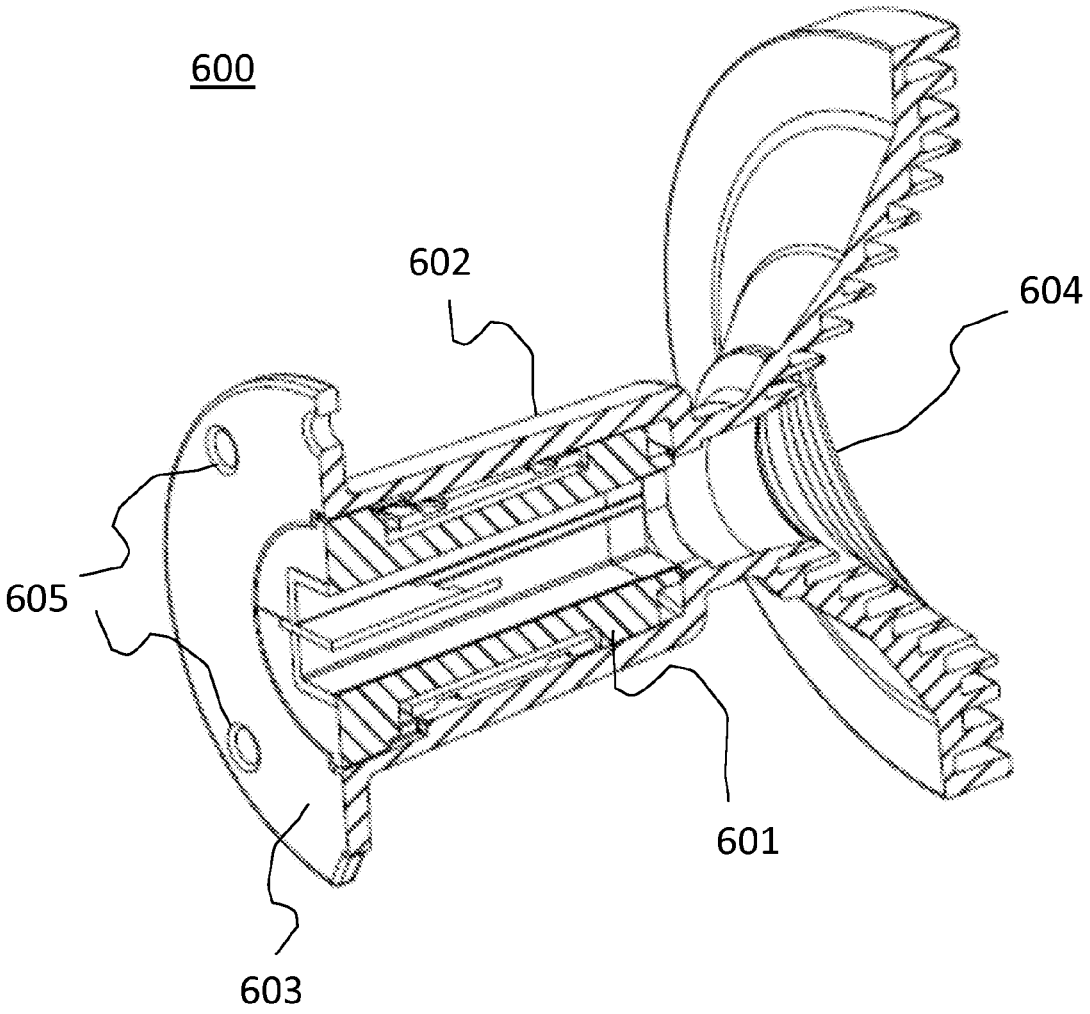
FIG. 6 is a perspective section view of another embodiment antenna horn.

FIG. 6 is a perspective section view of another embodiment antenna horn 600. Another embodiment polarizer assembly 601 is shown fully engaged with the extended housing 602. In an embodiment, the engagement means may be a press fit, clamped fit, threaded joint, or other suitable means.

Figure 7:
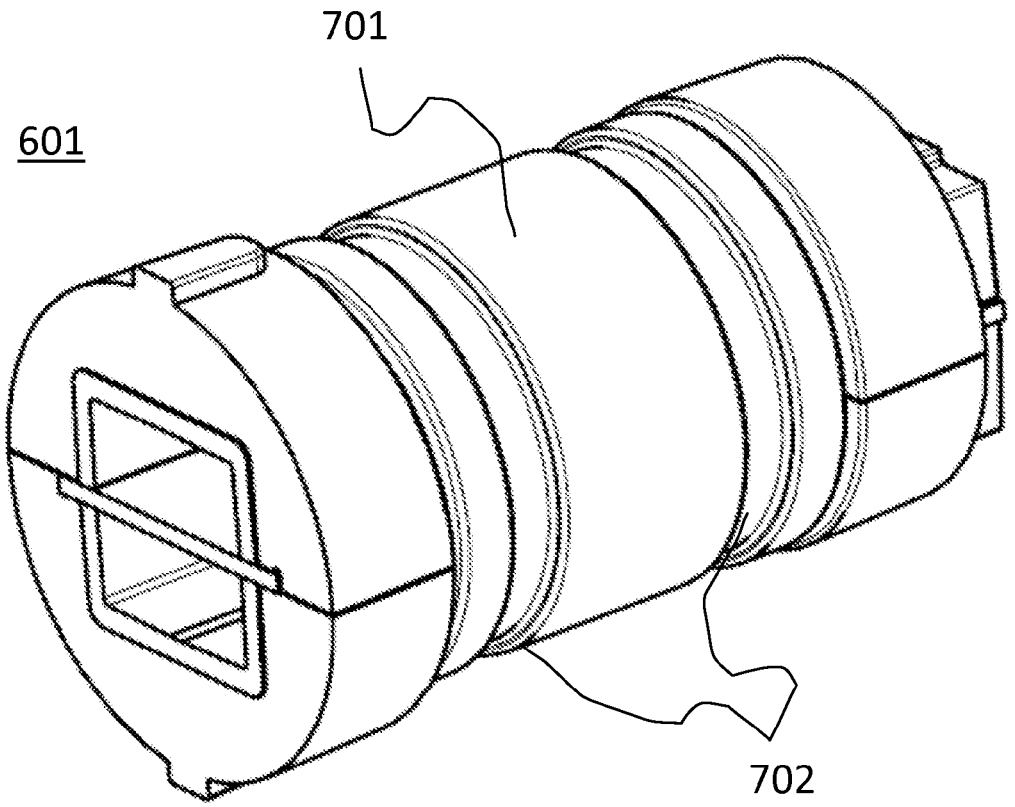
FIG. 7 is a perspective view of an embodiment polarizer assembly.
Figure 8:
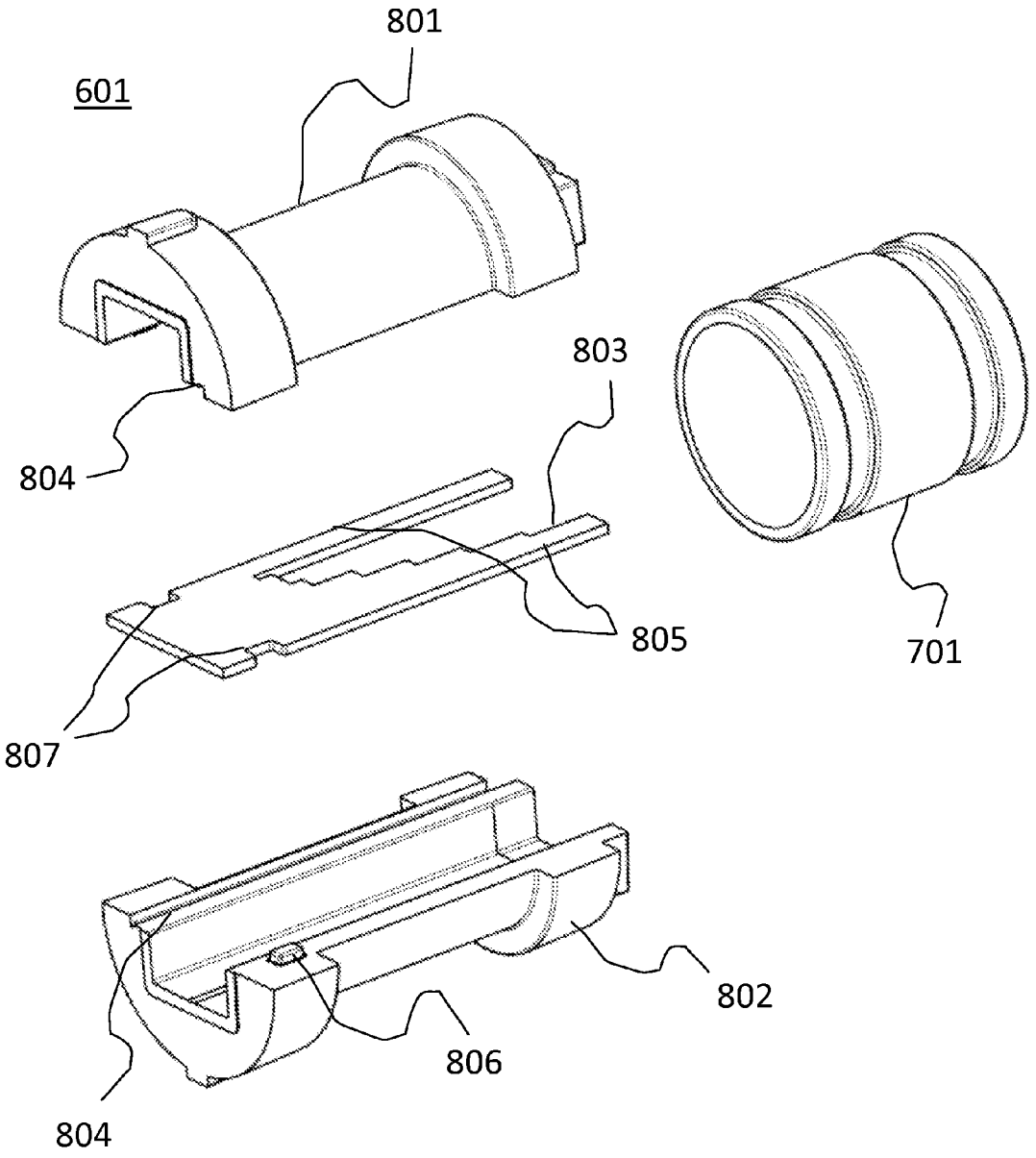
FIG. 8 is an exploded perspective view of FIG. 7.

FIG. 7 and FIG. 8 are perspective views of another embodiment polarizer assembly 601, where FIG. 8 is an exploded perspective view of FIG. 7. In an embodiment, polarizer assembly 601 may have a tube 701 inserted over the outer surface and may be crimped at locations 702. Application of crimping force may be performed by a tool. The crimping action of the tube 701 may secure together the first waveguide half 801, the second waveguide half 802, and the septum polarizer 803 therebetween by applying a radial force on the polarizer assembly 601. Polarizing septum alignment ridges 804 of the waveguide halves 801,802 may support longitudinal edges 805 of the septum polarizer 807. In this way, the extended housing 602 may not compress the polarizer assembly 601 upon insertion as in other previously disclosed embodiments (see FIG. 2). However, the polarizer assembly 601 may be clamped by an axial force between a second end 603, alternatively referred to as a waveguide interconnect 603, of the extended housing 602 and a transceiver housing (not shown). The clamping axial force may at least partially be generated from the polarizer assembly 601 extending beyond an end surface of the waveguide interconnect 603. In this way, the polarizer assembly 601 may contact the transceiver housing (not shown) before the waveguide interconnect 603 engages the transceiver housing (not shown).

In an embodiment, the waveguide interconnect 603 may be joined to the transceiver housing (not shown) using screws (not shown) placed through holes 605. When tightened, screws (not shown) may apply axial force to the waveguide interconnect 603 to engage the antenna horn 600 with the transceiver housing (not shown). Additional attachment means to bring the antenna horn 600 in rigid mating contact with the transceiver housing (not shown) are contemplated including a clamping mechanism, a press-fit, threaded coupling, a pipe thread and knuckle, threaded studs and nuts, or other suitable forms.

In an embodiment, the waveguide halves 801,802 may also comprise at least one protruding boss 806 adapted to engage at least one corresponding notch 807 in the polarizing septum 803 in order to longitudinally position the polarizing septum 803 within the polarizer assembly 601. In an embodiment, the waveguide halves 801,802 may be substantially identical in order to minimize part variation, increase volume, and reduce cost.

Figure 9:
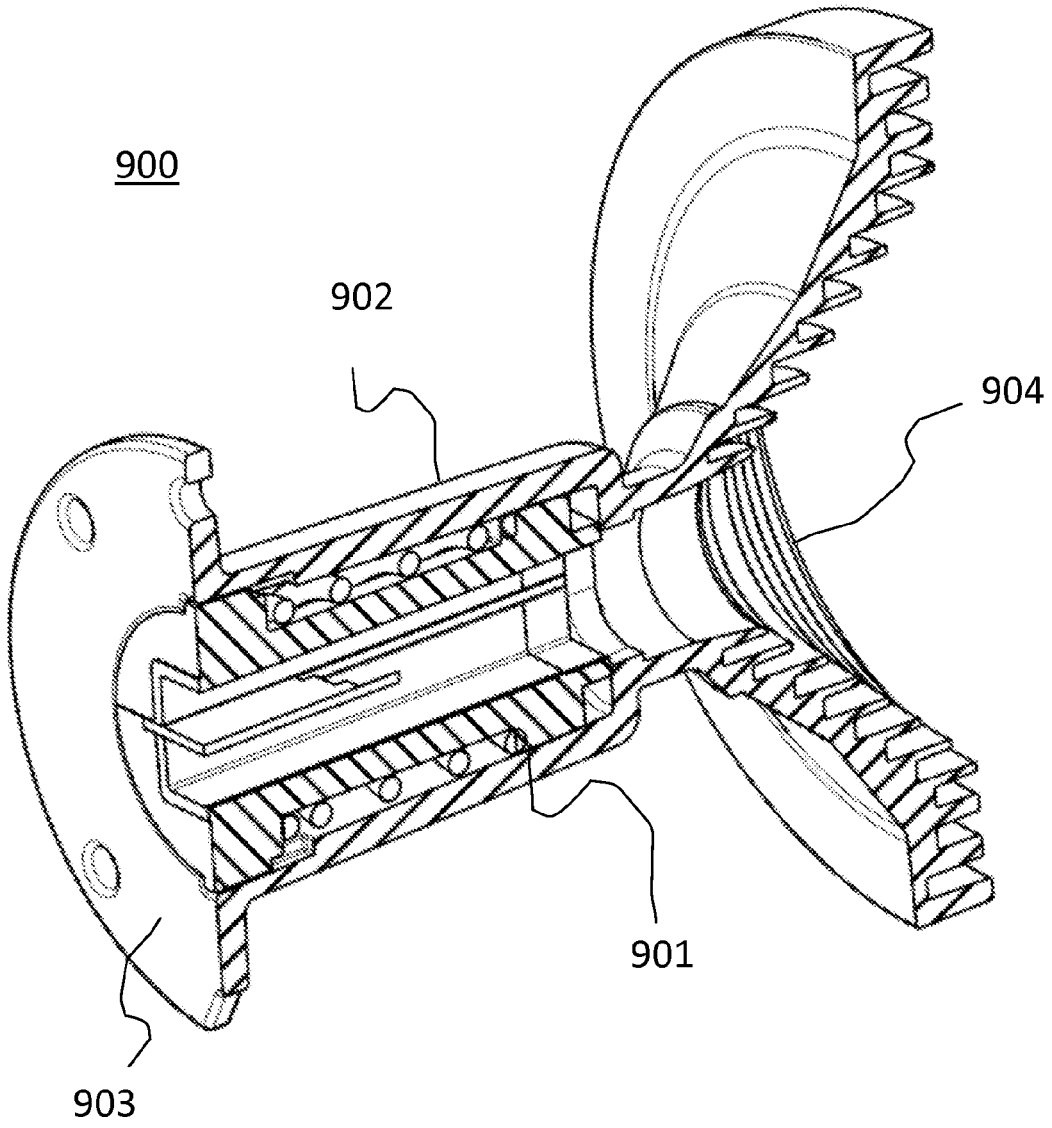
FIG. 9 is a perspective section view of still another embodiment antenna horn.

FIG. 9 is a perspective section view of still another embodiment antenna horn 900. Still another embodiment polarizer assembly 901 is shown fully engaged with the extended housing 902. In an embodiment, the engagement means may be a press fit, clamped fit, threaded joint, or other suitable means.

Figure 10:
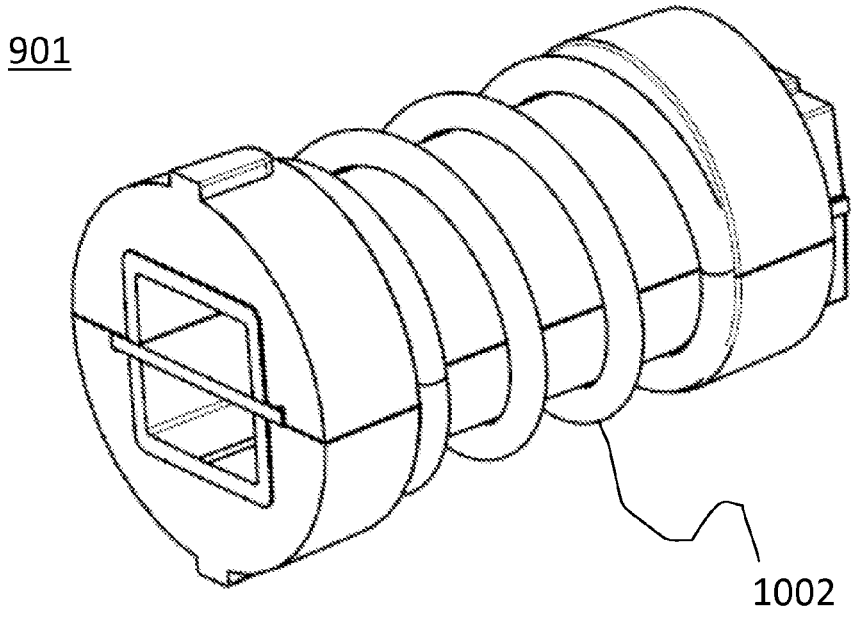
FIG. 10 is a perspective view of another embodiment polarizer assembly.
Figure 11:
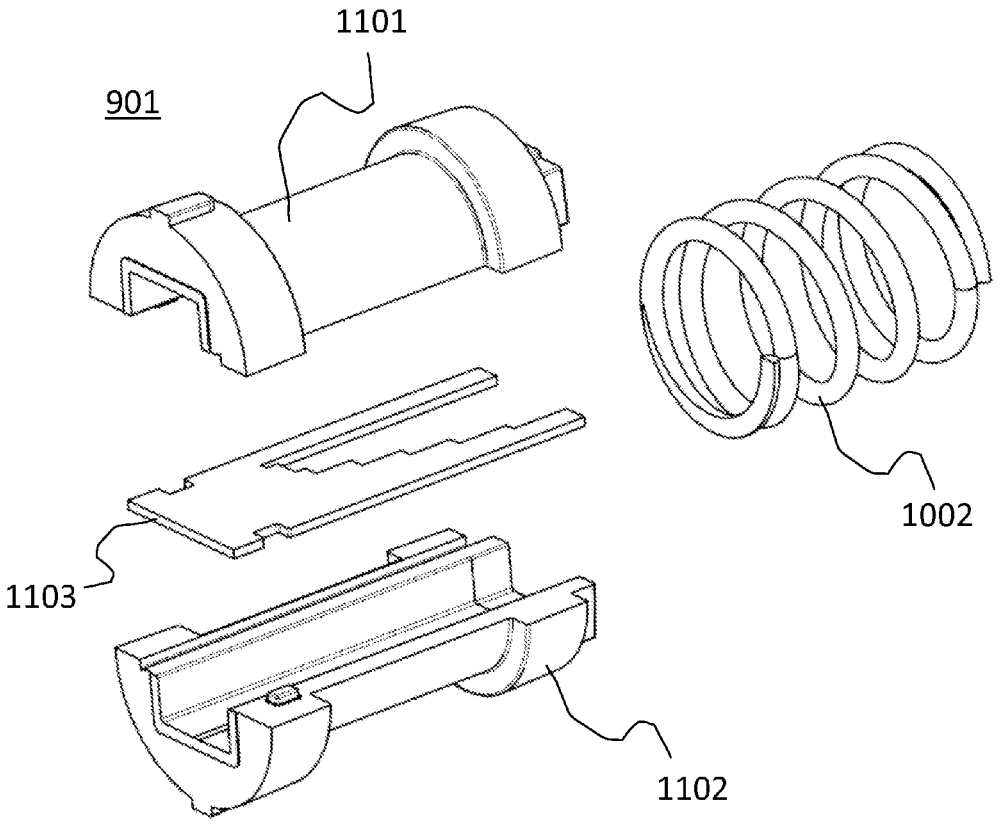
FIG. 11 is an exploded perspective view of FIG. 10.

FIG. 10 and FIG. 11 are perspective views of still another embodiment polarizer assembly 901, where FIG. 11 is an exploded perspective view of FIG. 10. In an embodiment, polarizer assembly 901 may have a spring clamp 1002 inserted over the outer surface. The insertion means may be a threading action, applying a torsional load to increase the inside diameter of the spring clamp 1002, both, or neither. Once installed, the spring clamp 1002 secures together the first waveguide half 1101, the second waveguide half 1102, and the septum polarizer 1103 therebetween via radial compression. Additional compression means may be employed such as a clamp ring, screws, bolts, a weld, a radial load imparted by the interior surface 202 (as in the antenna horn 100), or the like.

Figure 12:
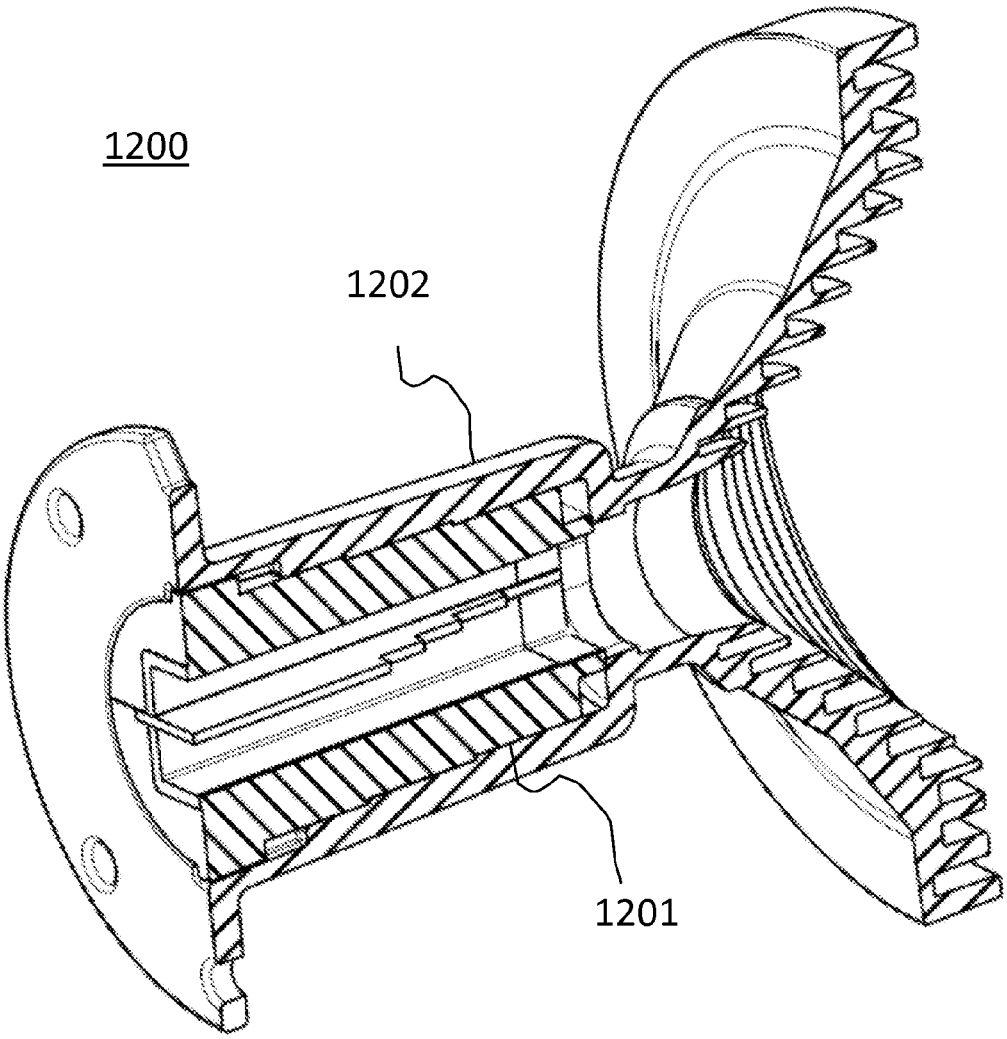
FIG. 12 is a perspective section view of yet another embodiment antenna horn.

FIG. 12 is a perspective section view of yet another embodiment antenna horn 1200. Another embodiment polarizer assembly 1201 is shown fully engaged with the extended housing 1202. In an embodiment, the engagement means may be a press-fit in which a plurality of substantially concentric cylinders on an exterior surface of the polarizer assembly 1201 engage a plurality of substantially concentric cylindrical bores within the interior surface of the extended housing 1202. It is contemplated that the plurality of cylinders and corresponding cylindrical bores may be tapered to minimize longitudinal length of engagement.

Figure 13:
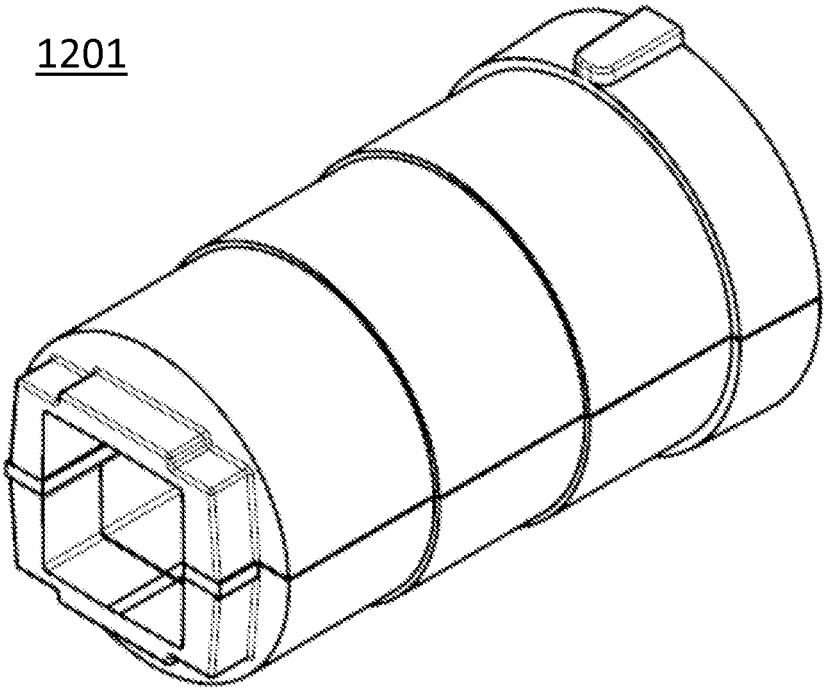
FIG. 13 is a perspective view of still another embodiment polarizer assembly.
Figure 14:
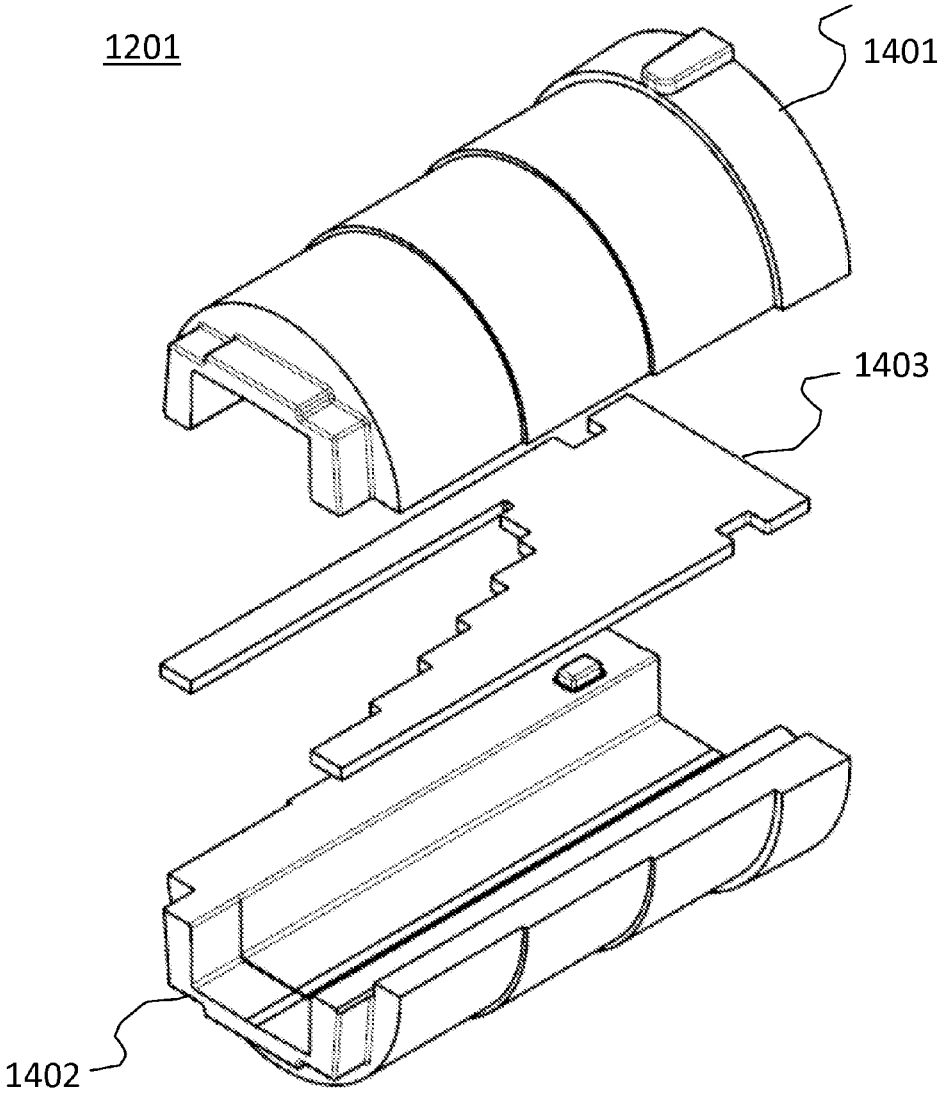
FIG. 14 is an exploded perspective view of FIG. 13.

FIG. 13 and FIG. 14 are perspective views of yet another embodiment polarizer assembly 1201, where FIG. 14 is an exploded perspective view of FIG. 13. In an embodiment, the waveguide halves 1401,1402 and polarizing septum 1403 may loosely join to form the polarizer assembly 1201 and the polarizer assembly 1201 may slide into the extended housing 1202. A force applied by the press-fit engagement may act in a direction substantially perpendicular and radially inward and may be transferred to the polarizing septum 1403 along its longitudinal edges. In this manner, the force substantially rigidly clamps the polarizing septum 1403 between the waveguide halves 1401,1402 to maximize signal transmission efficiency.

Figure 15:
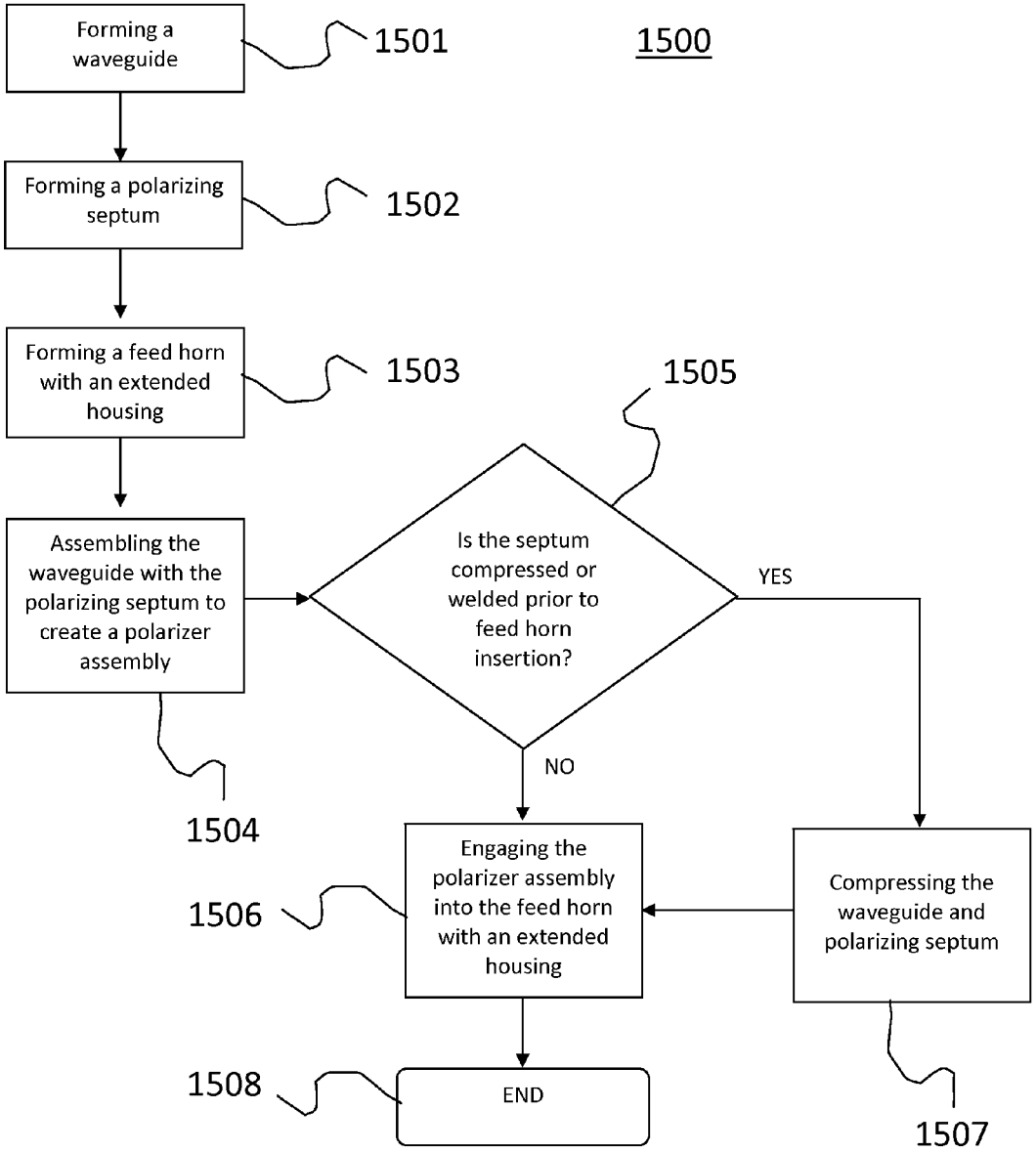
FIG. 15 is a flow chart of an embodiment manufacturing method.

FIG. 15 is a flow chart for manufacturing an antenna horn. In an embodiment, the process 1500 may begin with forming at least one waveguide according to any of the previously disclosed embodiments (step 1501). The polarizing septum may then be formed (step 1502) and then the feed horn with extended housing disposed about a central longitudinal axis may be formed (step 1503). Steps 1501 through 1503 may be performed in any sequential order.

In an embodiment, the waveguide and polarizing septum are assembled to form a polarizer assembly (step 1504). After 1504, the process is dependent upon the method in which the polarizer assembly is coupled (step 1505). For example, if the polarizer assembly is compressed during and/or after insertion into the interior cavity of the feed horn, then the polarizer assembly may be engaged into the feed horn (step 1506). Alternatively, if the polarizer assembly is compressed before insertion into the feed horn, the compressing means may be employed (step 1507). As previously disclosed, a group consisting of a spring clamp, a clamp ring, screws, bolts, a weld, a radial load imparted by a surface of the interior cavity may be the compression means. Next, the polarizer assembly may be engaged into the feed horn (step 1506) to create the product (step 1508). As previously disclosed, engaging means may be a press-fit, clamped fit, threaded joint, or other suitable means.

Figure 16:
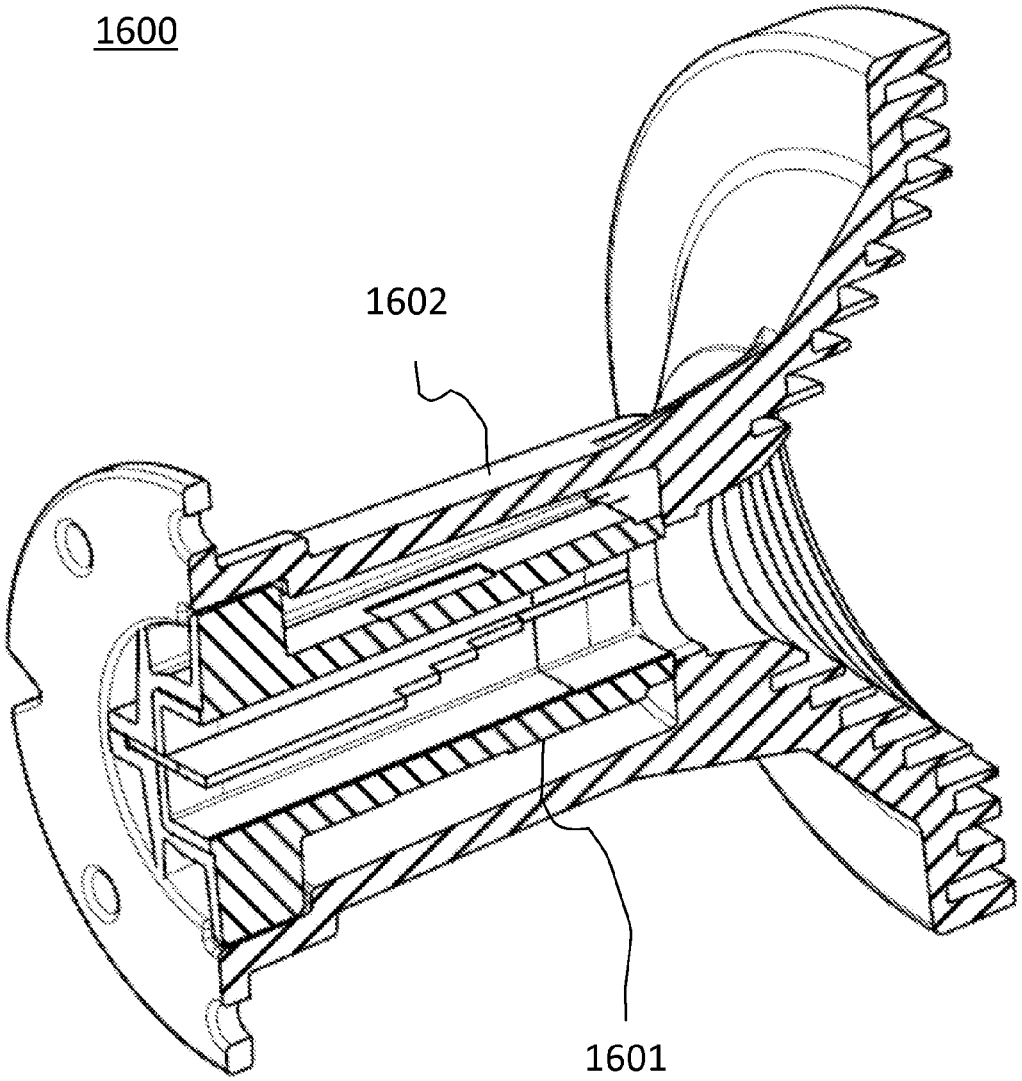
FIG. 16 is a perspective section view of yet another embodiment antenna horn.

FIG. 16 is a perspective section view of a horn assembly 1600 comprising further embodiments of an antenna horn 1602 and a polarizer assembly 1601. The polarizer assembly 1601 is shown fully engaged with the extended housing 1602. In an embodiment, the engagement means may be a press fit, clamped fit, threaded joint, or other suitable means.

Figure 17:
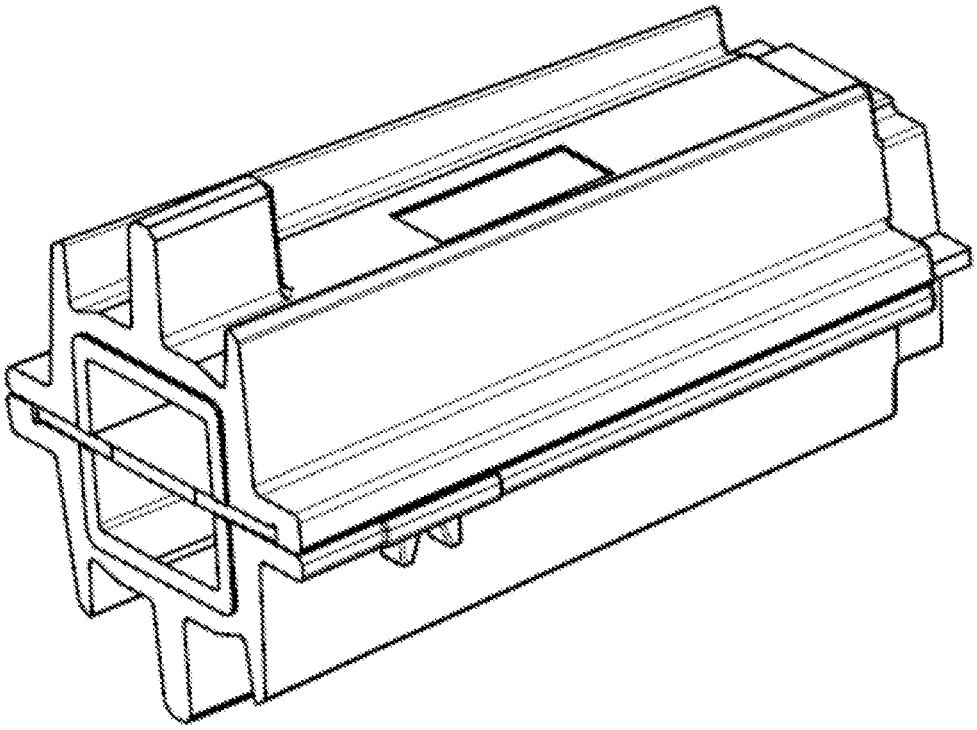
FIG. 17 is a perspective view of still another embodiment polarizer assembly.
Figure 18:
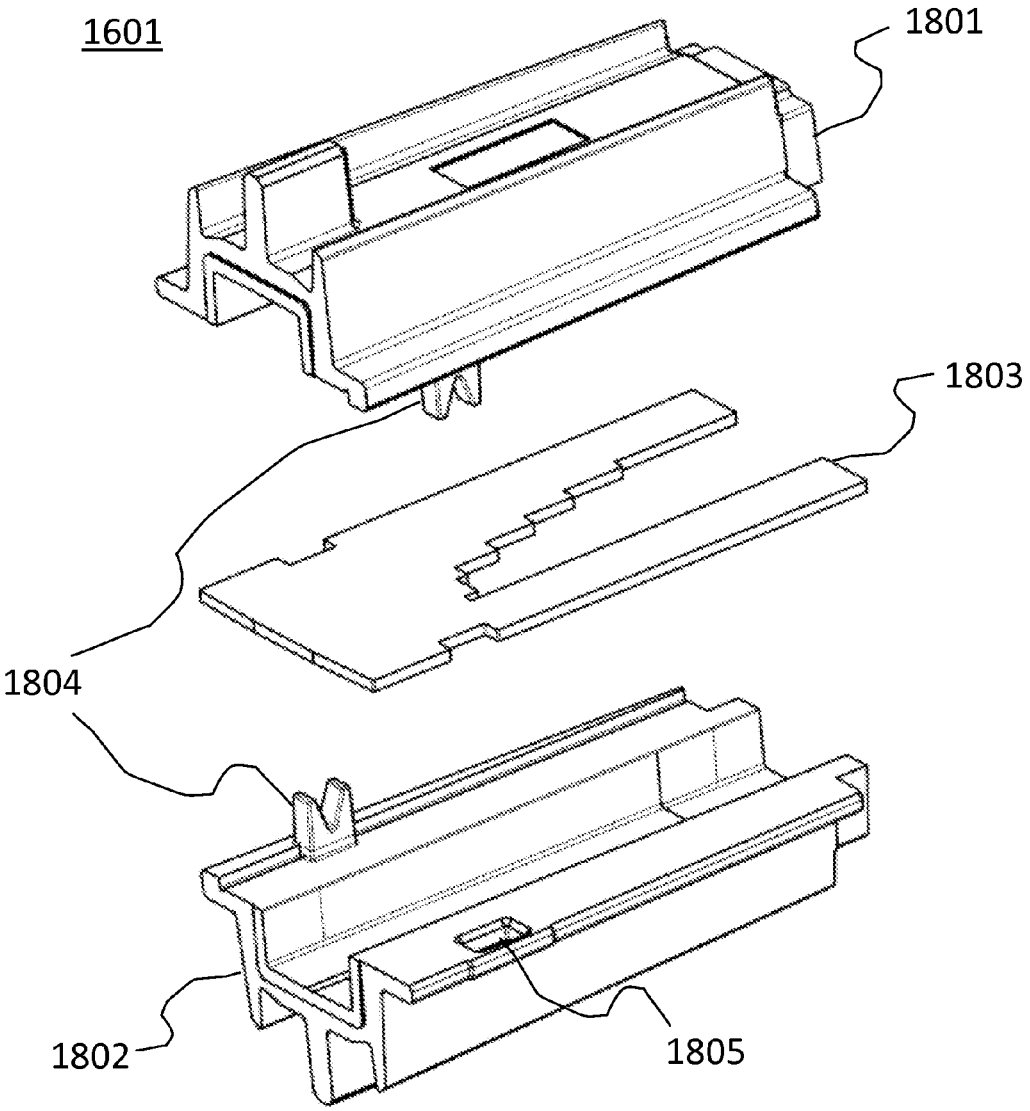
FIG. 18 is an exploded perspective view of FIG. 17.

FIG. 17 and FIG. 18 are perspective views of still another embodiment polarizer assembly 1601, where FIG. 18 is an exploded perspective view of FIG. 17. In this embodiment, the waveguide halves 1801,1802 and polarizing septum 1803 may loosely join to form the polarizer assembly 1801. One or more deformable tangs 1804 may engage corresponding slots 1805 upon assembling the waveguide halves 1801,1802. The polarizing septum 1803 may be more fully seated with the polarizer assembly 1801 through the use of a manufacturing fixture, hydraulic press, or other suitable means, in order to improve transmission efficiency. Permanent deformation may occur to spread the tang 1804 within the corresponding slot 1805 and temporarily join the waveguides halves 1801, 1802 before sliding the polarizer assembly 1601 into the extended housing 1602. Upon insertion of the polarizer assembly 1601 into the housing 1602, a force applied by the press-fit engagement may act in a direction substantially perpendicular and radially inward and may be transferred to the polarizing septum 1603 along its longitudinal edges. In this manner, the force may further clamp the polarizing septum 1603 between the waveguide halves 1801,1802 to maximize signal transmission efficiency. The arrangement provides for a uniform distribution of a clamping force so as to prevent deformation of the waveguide that could otherwise impose signal distortion.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparatus comprising:

a feed horn having a mouth aperture at a first end, a waveguide interconnect at a second end, and an integrated polarizer assembly housing between the first end and second end, the integrated polarizer assembly housing having an interior surface disposed about a central axis defining a longitudinal interior region; and a polarizer assembly in contact with at least a portion of the interior surface and contained substantially within the longitudinal interior region, the polarizer assembly comprising a waveguide channel and a polarizing septum positioned within the waveguide channel.

2. An apparatus of claim 1 wherein the polarizer assembly is press-fit into the longitudinal interior region.

3. The apparatus of claim 2 wherein the longitudinal interior region further comprises an engagement means that is adapted to engage the polarizer assembly only after partial insertion of the polarizer assembly into the interior region.

4. The apparatus of claim 3 wherein the engagement means comprises a conical interior surface substantially concentric with the central axis.

5. The apparatus of claim 4 wherein the polarizer assembly comprises a tapered exterior surface.

6. The apparatus of claim 3 wherein the engagement means comprises a plurality of cylinders substantially concentric with the central axis.

7. The apparatus of claim 1 further comprising a transceiver housing attached to the waveguide interconnect, wherein the transceiver housing imparts an axial force on the polarizer assembly.

8. The apparatus of claim 1 wherein the polarizer assembly comprises a first waveguide half and a second waveguide half.

9. The apparatus of claim 8 wherein the first waveguide half and the second waveguide half are held together by a compression means selected from the group consisting of a spring clamp, a crimp ring, screws, bolts, a weld, and a radial load imparted by the interior surface.

10. The apparatus of claim 8 wherein each of the first waveguide half and the second waveguide half comprise a polarizing septum alignment ridge.

11. The apparatus of claim 10 wherein each of the first waveguide half and the second waveguide half comprise a first mating surface and a second mating surface, and the polarizing septum alignment ridges are adjacent to the second mating surfaces, and wherein on a first side of the polarizer assembly the polarizing septum is positioned between the first mating surface of the first waveguide half and the alignment ridge of the second waveguide half, and wherein on a second side of the polarizer assembly the polarizing septum is positioned between the first mating surface of the second waveguide half and the alignment ridge of the first waveguide half.

12. The apparatus of claim 11 wherein the polarizing septum is substantially uniformly loaded along the polarizing septum alignment ridges.

13. The apparatus of claim 1 wherein the second end further comprises a key slot and the polarizer assembly further comprises a key adapted for insertion into the key slot.

14. An apparatus, comprising:

a unibody feed horn means having a polarizer assembly housing with a central longitudinal axis;

means for guiding a signal;

means for polarizing the signal;

means for nesting the signal polarizing means within the signal guiding means, wherein the nesting means comprises a polarizer assembly;

engaging means for engaging the polarizer assembly into the unibody feed horn means; and orienting means for orienting the polarizer assembly within the unibody feed horn means.

15. The apparatus of claim 14 wherein the engaging means is a press-fit that substantially uniformly applies force along at least one longitudinal edge of the signal polarizing means.

16. The apparatus of claim 14 wherein the engaging means is a clamping force substantially parallel to the longitudinal axis to clamp the guiding means between the unibody feed horn means and a transceiver housing.

17. The apparatus of claim 14 wherein the orienting means is at least one key slot and at least one key.

18. A method of manufacturing an apparatus, the method comprising:

forming a polarizer assembly having a waveguide and a polarizing septum;

obtaining a feed horn having an extended housing disposed about a central longitudinal axis, wherein the extended housing of the feed horn includes an interior cavity; and inserting the polarizer assembly into the extended housing of the feed horn.

19. The method of claim 18 wherein the polarizer assembly comprises two waveguide halves held together by a compression means selected from the group consisting of a spring clamp, a crimp ring, screws, bolts, a weld, and a radial load imparted by a surface of the interior cavity.

20. A product made by the method of claim 18.

* * * * *